United States Patent [19]

Magerowski et al.

[11] Patent Number: 4,967,967

[45] Date of Patent: Nov. 6, 1990

[54] METHOD OF HIGH CRUSHING FORCE CONICAL CRUSHING

[75] Inventors: Anthony J. Magerowski, Milwaukee; Vijia K. Karra, Franklin, both of Wis.

[73] Assignee: Nordberg Inc., Milwaukee, Wis.

[21] Appl. No.: 438,735

[22] Filed: Nov. 17, 1989

[51] Int. Cl.[5] ..... B02C 2/06

[52] U.S. Cl. ..... 241/21; 241/30; 241/37; 241/207

[58] Field of Search ..... 241/207-215, 241/36, 37, 30, 32, 21

[56] References Cited

U.S. PATENT DOCUMENTS

| | | |
|---|---|---|
| 3,078,051 | 2/1963 | Patterson . |
| 3,133,707 | 5/1964 | Zimmerman . |
| 3,305,181 | 2/1967 | Barrot et al. . |
| 3,328,888 | 7/1967 | Gieschen et al. . |
| 3,700,175 | 10/1972 | Saito . |
| 3,754,716 | 8/1973 | Webster . |
| 3,797,759 | 3/1974 | Davis et al. . |
| 4,179,074 | 12/1979 | Flavel . |
| 4,251,035 | 2/1981 | Chatwin et al. . |
| 4,272,030 | 6/1981 | Afanasiev et al. . |
| 4,357,287 | 11/1982 | Schonert . |
| 4,359,193 | 11/1982 | Schonert . |
| 4,566,638 | 1/1986 | Lundin et al. . |
| 4,615,491 | 10/1986 | Batch et al. . |
| 4,671,464 | 6/1987 | Karra et al. . |
| 4,750,681 | 6/1988 | Sawant et al. . |

OTHER PUBLICATIONS

Hanisch, J. and Schubert, H., "Compressive Comminution of Particle Beds", *Aufbereitungs-Technik*, No. 10/1986, pp. 535-540.

Karra, V., "Extension of Conventional Fine Crushing for Progressive Substitution of Conventional Grinding", presented at the International Syposium on "Challenges in Mineral Processing", *Society of Mining Engineers*, Dec. 7-10, 1988, Berkeley, Calif.

*Primary Examiner*—Mark Rosenbaum

*Attorney, Agent, or Firm*—Welsh & Katz, Ltd.

[57] ABSTRACT

A method of conical crushing to achieve the grinding of feed material includes narrowing the crusher setting beyond the specified minimum limit to enable the head to periodically exert high levels of compressive crushing force, interspersed with low pressure relief periods for mixing of the particles, the cycle of crushing periods corresponding with the gyrational cycle of the head. The method also includes increasing the releasing force exerted upon the crusher bowl to promote the grinding action of the crusher at its narrowed setting.

7 Claims, 2 Drawing Sheets

METHOD OF HIGH CRUSHING FORCE CONICAL CRUSHING

BACKGROUND OF THE INVENTION

The present invention relates to the use of conical crushers for the comminution of mineral material, and more specifically, to the use of a conical crusher in a grinding mode, i.e., to produce a higher percentage of fine sized product at a given throughput capacity.

In the comminution of mineral materials, the grinding step, or the reduction of the size of crushed particles to a relatively fine sized product, is commonly performed by tumbling rod or ball mills, and is conventionally accepted as one of the more, if not the most energy intensive step in the comminution process. As a result, efforts have been made to reduce energy consumption in the grinding operation.

One such suggested solution is embodied in U.S. Pat. No. 4,537,287 to Schoenert, who discloses performing grinding using a pair of parallel compression rollers oriented to have a relatively narrow gap therebetween, through which is inserted a flow of feed material. The rollers are designed to exert sufficient compressive forces on the material between the rollers to effect comminution of the feed material. In some cases, the compressive force of the rollers results in the creation of agglomerates or briquettes. The comminution system disclosed by Schoenert is inefficient in that it only utilizes a single step stressing process, which has been shown to consume higher energy for a given reduction ratio than a multi-step stressing process for the same given reduction ratio. Although devices such as Schoenert's, commonly known as roll presses, have been suggested for use in the cement industry for the comminution of "clinker" material, the conventional rod or ball mill still needs to be used as a finishing step in the production of fine materials after the roll press. Also, the roll press has not received commercial acceptance in the comminution of relatively harder materials such as taconite, copper, etc.

Conical crushers are normally used as secondary or tertiary stage comminution devices, and as such have not been used extensively for grinding. Commonly assigned U.S. Pat. No. 4,697,745 discloses that the setting of a conical crusher may be narrowed to increase the production of fines, and that the tightening or narrowing of the setting requires additional power to achieve equivalent crusher production rates. This additional power may be supplied by proportionately increasing the rotational speed of the eccentric. In addition, when the setting is narrowed beyond the design limits for a particular crusher unit, the designed crushing force in the lower margin of the bowl liner will be surpassed, causing the crusher to "bounce" through the generation of vibrations in the area of the adjustment ring. This crusher "bounce" has proved to be a significant obstacle to the use of conical crushers to produce high volumes of fine product.

Thus, there is a need for an energy efficient, stress managing method of operating a conical crusher to produce a significant volume of fines, and to essentially perform the grinding portion of a comminution circuit to enable the replacement of conventional ball mill or roll press grinding equipment.

SUMMARY OF THE INVENTION

Accordingly, the conical crusher of the invention produces a greater proportion of fines through the generation of highly compressive forces obtained by narrowing the crusher setting below the specified limit, and also by increasing the bowl release force above the specified limit to prevent the bowl from moving upwardly during normal operation.

More specifically, in order to achieve a high force, compression type conical crushing operation, the crusher is adjusted so that the crusher setting is narrower than the specified design limit for the crusher unit. In addition, the bowl releasing force, or the amount of pressure needed to overcome the preset bowl clamping force, is increased by increasing the releasing force above the specified design limit. When a conical crusher adjusted according to the invention is in operation, material fed into the crushing cavity experiences multiple periods of high force compressive crushing interspersed with mixing steps. This crushing/mixing cycle corresponds to the gyrational action of the head within the bowl. These modifications result in a crushing/mixing cycle which enhances the compressive comminution and grinding of particles to the desired size. A conical crusher incorporating the features of the invention may thus replace a conventional rod or ball grinding mill in a comminution circuit.

DESCRIPTION OF THE PREFERRED EMBODIMENT

Figure 1:
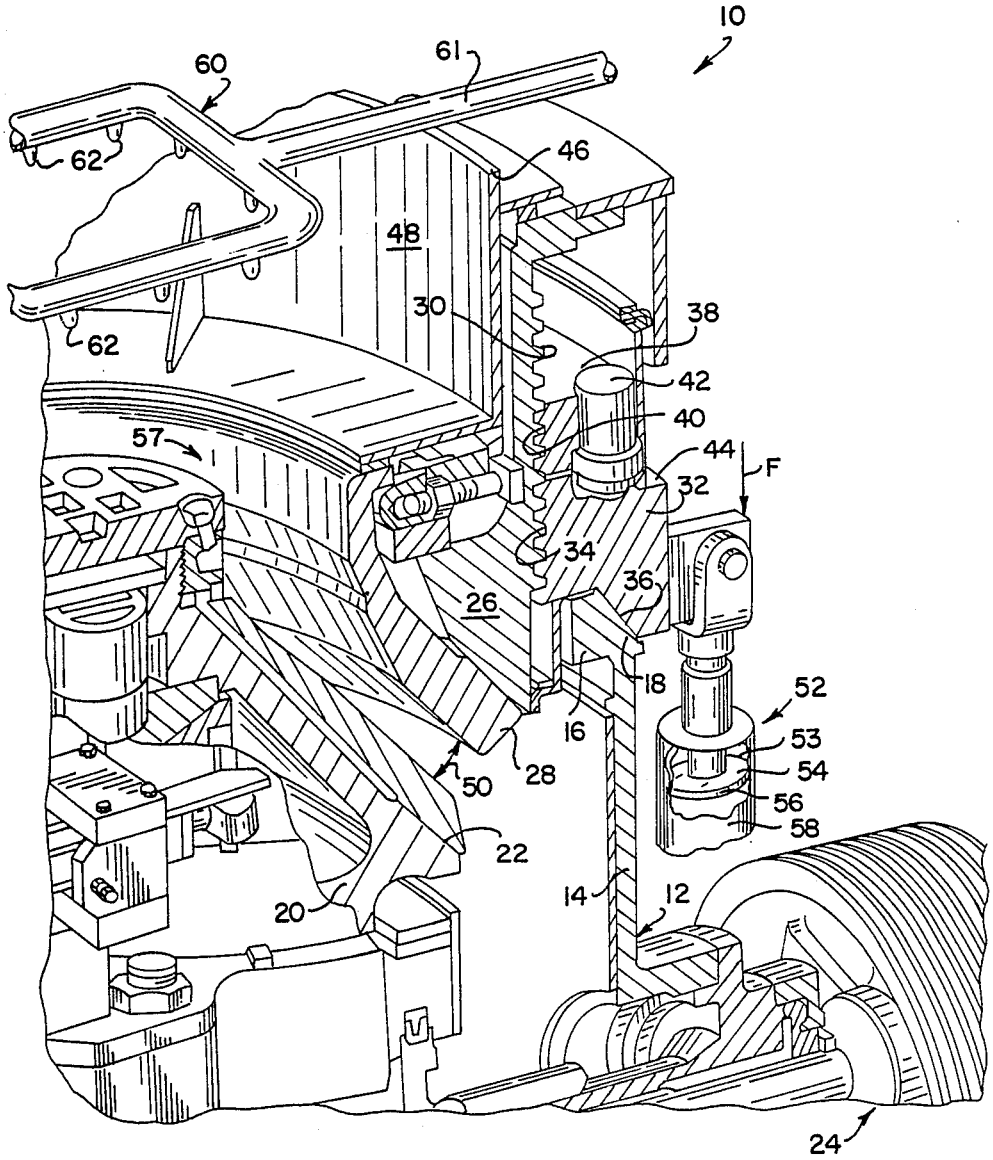
FIG. 1 is a fragmentary front perspective elevational cut-away view of a conical crusher of the type adjustable for operation according to the method of the invention.

The present invention pertains to conical crushers, the details of which are generally known in the art and are specifically described in commonly assigned U.S. Pat. No. 4,671,464 to Karra et al. issued June 9, 1987, the contents of which are incorporated by reference herein. Although U.S. Pat. No. 4,671,464 and the present application depict a specific type of conical crusher, that of a conical head driven by an eccentric for gyration about a fixed shaft, other operational configurations of conical crushers are contemplated, including, but not restricted to, hydraulic support cone crushers of the type having the head support shaft being vertically adjustable, as well as inertia cone crushers incorporating an out-of-balance flywheel weight with a ball and socket type drive transmission.

The present crusher, designated generally 10, includes a generally fixed mainframe housing 12 having a vertically projecting annular wall 14, the upper margin of which is provided with a thickened portion 16 with an angled surface 18 designated as a ring seat. A conical head 20 having a detachable outer mantle 22 is placed within the housing 12 and is connected to a drive system, partially shown and designated generally as 24, to effect a gyrational movement of the head within the housing. This gyration may be caused by an eccentric 25 (best seen in FIGS. 2–4) or other known means.

The head 20 gyrates within an upper portion of the crusher 10 including a negative concave surface defined by a bowl 26 which is provided with a bowl liner 28. The bowl 26 has an annular configuration, the outer surface 30 of which is helically threaded to permit vertical adjustment of the bowl. An adjustment ring 32 is disposed around the outer periphery of the bowl 26 and is also provided with inwardly projecting threads 34. The adjustment ring 32 has a lower surface 36 which, in the present embodiment, is beveled to complement the ring seat surface 18 of the housing 12.

A clamping ring 38 is disposed above the adjustment ring 32 and is also helically threaded on an interior surface 40 so as to be threadably engaged to the outer surface of the bowl 30. At least one pressure cylinder 42 is provided to exert a locking force upon the upper surface 44 of the adjustment ring 32. The upper portion 46 of the bowl 26 is configured to form a hopper 48. The bowl 26, the bowl liner 28, the adjustment ring 32, the clamping ring 38 and the hopper 48 may collectively be referred to as the bowl assembly.

Prior to operation, the crusher 10 is adjusted to have a specified setting or gap 50 between the head mantle 22 and the bowl liner 28. The setting 50 is obtained by hydraulically releasing the clamping cylinders 42 on the locking ring and rotating the bowl 26 until a desired gap 50 is obtained. The setting 50 is secured by repressurizing the clamping cylinders 42. Generally, the narrower the setting 50, the finer the resulting crushed product.

Conventional conical crushers normally have some sort of mechanism for facilitating the rapid passage of tramp material, such as tramp iron and/or agglomerated fine particles, and such apparatus normally either takes the form of a plurality of hydraulic tramp release cylinders 52 or alternatively, coiled tramp release springs (not shown). During normal operation, hydraulic fluid is pumped into an upper portion 53 of the cylinder 52 to exert pressure against an upper side 54 of a piston 56. As is known in the art, and, for reference purposes, is disclosed in commonly assigned U.S. Pat. No. 4,478,373, the pertinent parts of which are incorporated by reference herein, in normal operation, the tramp release cylinders 52 exert a predetermined releasing force indicated by the arrow 'F' upon the crusher bowl 26 through the adjustment ring 32.

The force 'F' thus holds the ring 32 against the housing 14, with the adjustment ring surface 36 being in a contacting relationship with the ring seat surface 18.

Once a piece of noncrushable tramp material becomes lodged in a crushing cavity designated generally 57, the head 20 will exert sufficient upward force against the bowl 26 through the tramp material to overcome the releasing force 'F' exerted by the tramp release cylinders 52. Once a predesignated pressure level is exceeded, a trigger valve (not shown) allows hydraulic fluid to be pumped from the upper portion 53 and into an accumulator (not shown) to raise the bowl vertically. Thus, the bowl 26 is lifted to temporarily widen the setting 50 and allow the passage of the tramp material without damaging the crusher 10. Once the tramp material has passed through the crusher, the hydraulic fluid is forced from the accumulator back into the upper portion 53 of the cylinder 52, and the bowl 26 resumes its position upon the ring seat 18.

If desired, a water supply apparatus 60 may be disposed generally above the bowl 26 and the head 20. The apparatus 60 is basically a conduit 61 provided with a plurality of nozzles 62 which each direct a stream of water into the crushing cavity 57 of the crusher 10. The water injected into the cavity 57 by the apparatus 60 moistens the head mantle 22 and the bowl liner 28. A buildup of fines is thus prevented in the crushing gap 50. Such an apparatus is described in greater detail in U.S. Pat. No. 4,671,474.

Conventional conical crushers are manufactured with certain design parameters, i.e., depending on the size of the unit and its structural support characteristics, the setting 50 will be within a designed range. For most conical crushers, the narrowest crusher setting within the range is approximately $\frac{3}{8}''$. It has been found that providing a setting that is narrower than the designed minimum setting tends to cause excessive crusher vibration or "bounce", in the area of the ring 32. It has also been found, however, that when the crusher setting 50 is narrowed substantially beyond the preset minimum limit, i.e., on the order of 1/16" for a crusher with a specified narrowest setting of approximately $\frac{3}{8}''$, significant compressive crushing forces may be generated. These compressive forces produce a significantly finer product and allow the crusher 10 to be used as an energy efficient substitute for a ball or rod mill or a roll press.

To accommodate crushing at the narrowed setting, the power to the crusher is increased by increasing the eccentric speed over the specified maximum limit. The eccentric speed is increased by increasing the rotational speed of the drive system 24.

Another modification which is preferably made to the crusher 10 to achieve high force crushing is an increase in the releasing force 'F', over a specified maximum limit for the crusher 10, which in effect increases the amount of force required to lift the bowl 26 when tramp material is present. This increased force 'F' allows the bowl 26 to better withstand the compressive forces generated by narrowing the setting 50 beyond the specified maximum limit, and promotes the grinding action of the head 20 at its narrowed setting. In the preferred embodiment, the releasing force 'F' is increased in the range of 30% to 150% over the specified maximum design limit for the particular crusher model 10.

Figure 4:
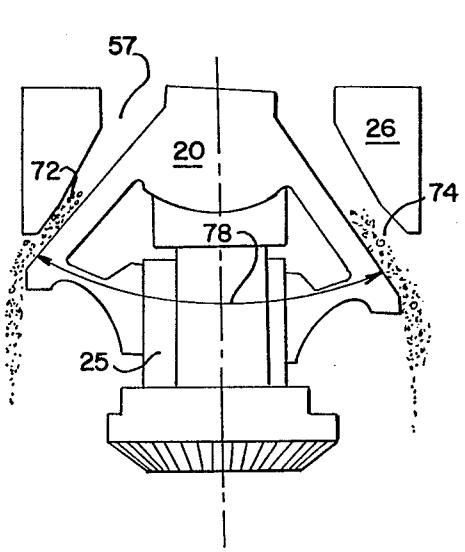
FIG. 4 is a diagrammatic vertical sectional view of the third stage of the crushing/mixing process first depicted in FIG. 2.
Figure 3:
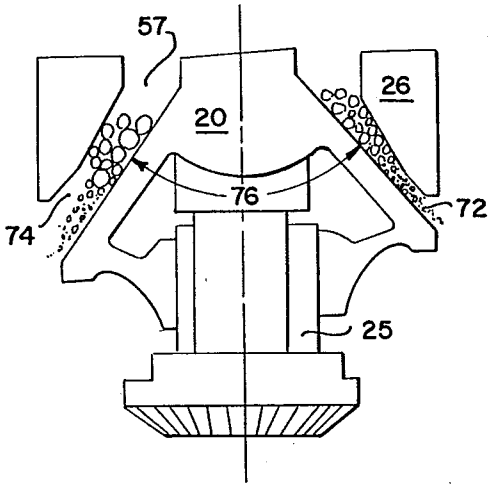
FIG. 3 is a diagrammatic vertical sectional view of the second stage of the process shown in FIG. 2.
Figure 2:
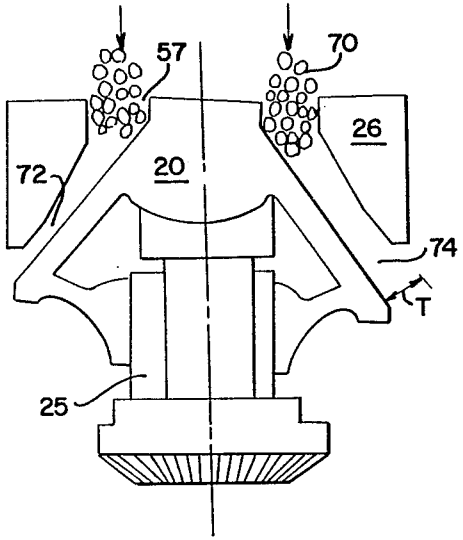
FIG. 2 is a diagrammatic vertical sectional view of a first stage in the crushing/mixing process of the invention.

Referring now to FIGS. 2–4, a conical crusher adjusted for narrow setting or high compression force crushing will induce a multi-step stressing of a bed of feed material 70. Referring now to FIG. 2, the crushing head 20 follows a gyrational cycle within the bowl 26 between a closed or crushing/stressing phase shown at 72 and a relaxed or no-load phase 74. It is during the crushing phase 72 that the feed material 70 begins to be comminuted and formed into a particle bed. In FIG. 2, the feed material 70 is shown entering the crushing cavity 57.

With the setting 50 adjusted to be narrower than designed for the specific crusher unit 10, the head 20 exerts a compressive crushing action upon the bed of material 70 which promotes the production of a significantly greater proportion of fines than obtained by merely narrowing the setting up to the design limit. When the head 20 gyrates to its no-load phase 74, the material is allowed to shift and loosen, and particles are able to mix relative to each other. The increased releasing force 'F' prevents unwanted crusher 'bounce' and secures the bowl 26 in place to achieve more complete grinding of the feed material.

Aside from the crusher setting 50 and the releasing force 'F', another parameter of conical crusher operation is the throw 'T' (best seen in FIG. 2) of the head 20, which is measured by the displacement of the head 20 between the widest opening in the no-load phase 74 and the narrowest point in the crushing phase 72. The head throw is dependent on crusher size and is altered by changing the eccentricity of the eccentric 25.

Referring now to FIG. 3, after the first gyrational cycle, the material 70 shifts downwardly during the no-load phase to an interim position 76 on the head mantle 22. The material now undergoes a second crushing or stressing phase similar to that which occurred in FIG. 2. Also, a subsequent mixing phase will occur during the no-load position 74 as was also depicted in FIG. 2.

Referring now to FIG. 4, as the bed of material 52 shifts lower upon the mantle 22 to a position 78, a third crushing/mixing cycle will occur. Subsequent to this final crushing/mixing phase, the material 70 has now been ground to its desired fine grade, and will pass through the crusher 10. Thus, the gyrational action of the head 20 within the bowl 26 exerts a multiple crushing/mixing action upon the feed material 70, and the exact number of crushing/mixing cycles may vary with the nature of the feed material and the gyrating speed of the cone crusher.

When a given degree of reduction is performed by this compressive multi-stressing procedure, with the loosening/mixing process occurring between the compression/crushing steps, the energy required for that reduction may be reduced by as much as 30–50% over processes using only one stressing step.

Should the stress/mixing cycle of the present high performance crushing operation generate briquettes of finely ground compressed material, or should that material be merely passed through the crusher as powder, either crushed product will be more easily broken up or comminuted as it is passed through a subsequent comminution step than if the comminution were carried out in conventional fashion. In any event, the crusher 10 of the invention produces a sufficient quantity of fine sized particles to enable it to replace a conventional ball or rod type grinding mill in a comminution circuit.

Thus, through the adjustment of a crusher 10 to achieve the present high crushing force crushing, in which the crusher setting 50 is narrowed significantly below a conventional and specified design limit, and the releasing force 'F' is increased above a specified design limit, the conical crusher 10 performs a cyclical stress or crushing/mixing operation to create a larger volume of finely crushed product than that provided by conventionally adjusted crushing apparatus, and at a fraction of the required energy.

While a particular embodiment of the conical crushing method of the invention has been shown and described, it will be appreciated by those skilled in the art that changes and modifications may be made thereto without departing from the invention in its broader aspects and as set forth in the following claims.

We claim:

1. A method of crushing particulate feed material in a conical crusher having a conical head member disposed for gyration about a vertical axis within a mainframe housing and circumscribed by a fixed bowl having a bowl liner with a negative conical crushing surface, the bowl being releasably biased against the housing by a specified releasing force, the releasing force having a specified maximum limit, the crusher setting, or the vertical position of the bowl relative to the head being adjustable, the setting being at a point within a specified range and having a specified minimum limit, the head gyrating at a specified speed, the crusher operating at a specified power value, the power and speed having specified maximum limits, the method comprising:

narrowing the crusher setting beyond the specified minimum limit to create periods of high force crushing of the feed material, said high force periods being interspersed with periods of relaxing of said high forces which allow for a mixing and gradual downward movement of the feed material;

increasing the releasing force above the specified maximum limit to promote the grinding action of the crusher at said narrowed setting;

increasing the power to the crusher over the specified maximum limits;

introducing the feed material into the crusher so that it falls between the conical head and the bowl line; and crushing the material at said narrowed setting and at said increased release force and power so that a significant proportion of fines are produced.

2. The method as defined in claim 1 wherein the specified range of said crusher setting includes a narrowest setting of approximately $\frac{3}{8}''$ and said method further includes narrowing said setting to approximately 1/16".

3. The method as defined in claim 1 wherein increasing the power value over the specified maximum value also increases the gyrating speed of the head over the specified maximum speed.

4. The method as defined in claim 1 wherein said releasing force is increased in the range of 30 to 150% over the specified releasing force.

5. The method defined in claim 1 further including increasing the gyrational speed above the specified limit.

6. The method as defined in claim 1 further including providing means for directing a spray of fluid into said crusher to moisten said head and said bowl liner.

7. A method of adjusting a conical crusher for generating a significant proportion of fines, the conical crusher having a conical head member disposed for gyration about a vertical axis within a mainframe housing and circumscribed by a fixed bowl having a bowl liner with a negative conical crushing surface, the bowl being releasably biased against the housing by a specified releasing force, the releasing force having a specified maximum limit, the crusher setting, or the vertical position of the bowl relative to the head being adjustable, the setting being at a point within a specified range and having a specified minimum limit, the head gyrating at a specified speed, the crusher operating at a specified power value, the power and speed having specified maximum limits, the method comprising:

narrowing the crusher setting beyond the specified minimum limit to create periods of high force crushing of the feed material, said high force periods being interspersed with periods of relaxing of said high forces which allow for a mixing and gradual downward movement of the feed material;

increasing the releasing force above the specified maximum limit to promote the grinding action of the crusher at said narrowed setting; and increasing the power to the crusher over specified maximum limits.

* * * * *

UNITED STATES PATENT AND TRADEMARK OFFICE

CERTIFICATE OF CORRECTION

PATENT NO. : 4,967,967

DATED : November 6, 1990

INVENTOR(S) : Anthony J. Magerowski and Vijia K. Karra

It is certified that error appears in the above-identified patent and that said Letters Patent is hereby corrected as shown below:

Column 6, line 20, delete "line" and insert --liner--.

Signed and Sealed this

Fourteenth Day of July, 1992

*Attest:*

DOUGLAS B. COMER

*Attesting Officer*

*Acting Commissioner of Patents and Trademarks*